US010597932B1

(12) United States Patent
Cipri

(10) Patent No.: US 10,597,932 B1
(45) Date of Patent: Mar. 24, 2020

(54) SWINGING TYPE FIRE DOOR

(71) Applicant: John Cipri, Farmingdale, NY (US)

(72) Inventor: John Cipri, Farmingdale, NY (US)

( * ) Notice: Subject to any disclaimer, the term of this patent is extended or adjusted under 35 U.S.C. 154(b) by 0 days.

(21) Appl. No.: 16/540,283

(22) Filed: Aug. 14, 2019

(51) Int. Cl.

| | |
|---|---|
| ***E06B 5/16*** | (2006.01) |
| ***E06B 3/70*** | (2006.01) |
| ***A62C 2/06*** | (2006.01) |
| ***E06B 3/72*** | (2006.01) |

(52) U.S. Cl.
CPC ..... *E06B 5/16* (2013.01); *A62C 2/06* (2013.01); *E06B 3/7015* (2013.01); *E06B 3/726* (2013.01); *E06B 5/161* (2013.01); *E05Y 2900/134* (2013.01); *E06B 2003/7042* (2013.01)

(58) Field of Classification Search
CPC ..... E06B 3/7015; E06B 3/726; E06B 2003/7032; E06B 2003/7042; E06B 2003/7051; E06B 2003/7078; E06B 2003/7073; E06B 2003/7074; E06B 5/16; E06B 5/161; E06B 5/162; E06B 3/822; E06B 2003/7076; E04C 2002/3477
USPC ... 52/784.1, 784.11, 784.14, 784.15, 783.13, 52/783.17; 49/501
See application file for complete search history.

(56) References Cited

U.S. PATENT DOCUMENTS

| | | | | | |
|---|---|---|---|---|---|
| 747,149 | A * | 12/1903 | Dahlstrom | 52/784.15 | |
| 1,159,411 | A * | 11/1915 | Olberg | E06B 5/16 | 52/784.11 |
| 1,581,038 | A * | 4/1926 | Thompson | E06B 5/16 | 52/784.11 |
| 2,889,899 | A * | 6/1959 | Bianco | E06B 3/726 | 52/656.4 |
| 4,282,687 | A * | 8/1981 | Teleskivi | E06B 5/16 | 428/688 |
| 4,822,657 | A * | 4/1989 | Simpson | B32B 7/02 | 428/69 |
| 4,837,999 | A * | 6/1989 | Stayner | E04B 7/22 | 52/309.11 |
| 5,390,466 | A * | 2/1995 | Johnson | E04B 7/22 | 52/309.16 |
| 5,640,824 | A | 6/1997 | Johnson et al. | | |
| 6,209,273 | B1 * | 4/2001 | Jeffers | E04B 2/7448 | 52/220.7 |

(Continued)

FOREIGN PATENT DOCUMENTS

| | | |
|---|---|---|
| CN | 201368318 Y | 12/2009 |
| CN | 203584230 U | 5/2014 |

(Continued)

OTHER PUBLICATIONS 4 page PDF, Machine translation of FR 2717530, Sep. 1995. (Year: 1995).*

(Continued)

*Primary Examiner* — Robert Canfield
(74) *Attorney, Agent, or Firm* — Sorell, Lenna & Schmidt, LLP

(57) ABSTRACT

A swinging type fire door includes a frame having opposite top and bottom walls and opposite first and second side walls each extending from the top wall to the bottom wall. A first tube is coupled to the top wall. A second tube is coupled to the bottom wall. An inner wall has a first end coupled to the first tube and a second end coupled to the second tube. A filler material is positioned between the inner wall and at least one of the side walls.

20 Claims, 5 Drawing Sheets

(56) References Cited

U.S. PATENT DOCUMENTS

| | | | | |
|---|---|---|---|---|
| 7,211,318 | B2 | 5/2007 | Lee et al. | |
| 7,934,349 | B1 * | 5/2011 | Romig | E04B 2/7457 52/309.1 |
| 8,656,683 | B2 * | 2/2014 | Hedditch | A62C 3/14 52/202 |

FOREIGN PATENT DOCUMENTS

| | | | | | |
|---|---|---|---|---|---|
| CN | 205012873 | U | | 2/2016 | |
| CN | 206228794 | U | | 6/2017 | |
| DE | 1954555 | A1 | * | 5/1971 | E06B 5/16 |
| DE | 2525309 | A1 | * | 12/1976 | E06B 5/16 |
| EP | 360375 | A | * | 3/1990 | E06B 5/11 |
| EP | 1239093 | A2 | | 9/2002 | |
| EP | 2180130 | A1 | * | 4/2010 | E06B 3/726 |
| EP | 2808478 | A1 | * | 12/2015 | E06B 5/16 |
| EP | 1536297 | A2 | | 6/2016 | |
| ES | 1139543 | U | | 8/2015 | |
| FR | 2558888 | A1 | * | 8/1985 | E06B 3/726 |
| FR | 2568622 | A | * | 2/1986 | E06B 3/82 |
| FR | 2717530 | A1 | * | 9/1995 | E06B 5/16 |
| GB | 382325 | A | * | 10/1932 | E06B 3/7015 |
| GB | 2081787 | A | * | 2/1982 | E06B 5/16 |
| GB | 2102869 | A | * | 2/1983 | E06B 5/16 |

OTHER PUBLICATIONS 7 page PDF, Machine translation FR 2558888, 1985. (Year: 1985).*
12 page PDF, Knaufinsulation, Safety Data Sheet Earthwool (R), Oct. 2018. (Year: 2018).*
4 page PDF, Knaufinsulation Glass Mineral Wool with ECOSE (R) TGechnology, 2016. (Year: 2016).*

* cited by examiner

SWINGING TYPE FIRE DOOR

TECHNICAL FIELD

The present disclosure generally relates to fire doors, and more particularly to insulated fire doors with improved resistance to heat and/or ballistics. Methods of producing and using the improved fire doors are provided.

BACKGROUND

Fire doors are designed to resist a rise in temperature over a desired degree on the side of the door opposite the fire or other combustion source. Fire doors maintain a certain degree of rigidity to resist gaps or other openings from developing, which may allow flames to move around or through the door. Conventional fire doors may provide a required amount of resistance to heat and/or ballistics. However, such conventional fire doors are often quite thick to provide the required amount of resistance to heat and/or ballistics. Due to their increased thickness, conventional fire doors cannot be retrofit onto an existing door frame, such as, for example, an existing steel door frame and thus require a custom door frame in order to be properly installed in a building or other structure. This disclosure describes an improvement over these prior art technologies.

SUMMARY

In one embodiment, in accordance with the principles of the present disclosure, a swinging type fire door comprises a frame comprising opposite top and bottom walls and opposite first and second side walls each extending from the top wall to the bottom wall. A first tube is coupled to the top wall. A second tube is coupled to the bottom wall. An inner wall has a first end coupled to the first tube and a second end coupled to the second tube. A filler material is positioned between the inner wall and at least one of the side walls.

In one embodiment, in accordance with the principles of the present disclosure, a swinging type fire door comprises a frame comprising opposite top and bottom walls and opposite first and second side walls each extending from the top wall to the bottom wall. A first tube is coupled to the top wall. A second tube is coupled to the bottom wall. Spaced apart first and second inner walls each have a first end coupled to the first tube and a second end coupled to the second tube. A plurality of spaced apart first stiffeners are positioned between the first side wall and the first inner wall. A plurality of spaced apart second stiffeners are positioned between the second side wall and the second inner wall. A filler material is positioned between adjacent first stiffeners and adjacent second stiffeners.

In one embodiment, in accordance with the principles of the present disclosure, a swinging type fire door comprises a frame comprising opposite top and bottom walls and opposite first and second side walls each extending from the top wall to the bottom wall. A first tube is coupled to the top wall by spaced apart socket drive machine screws. A second tube is coupled to the bottom wall by spaced apart socket drive machine screws. Spaced apart first and second inner walls each have a first end coupled to the first tube and a second end coupled to the second tube. A plurality of spaced apart first stiffeners are positioned between the first side wall and the first inner wall. A plurality of first fasteners extend through the first inner wall and into one of the first stiffeners to couple the first stiffeners to the frame. A plurality of spaced apart second stiffeners are positioned between the second side wall and the second inner wall. A plurality of second fasteners extend through the second inner wall and into one of the second stiffeners to couple the second stiffeners to the frame. A filler material is positioned between adjacent first stiffeners and adjacent second stiffeners. The filler material comprises about 87% of biosoluble glass mineral wool and about 13% of a thermoset inert polymer bonding agent.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
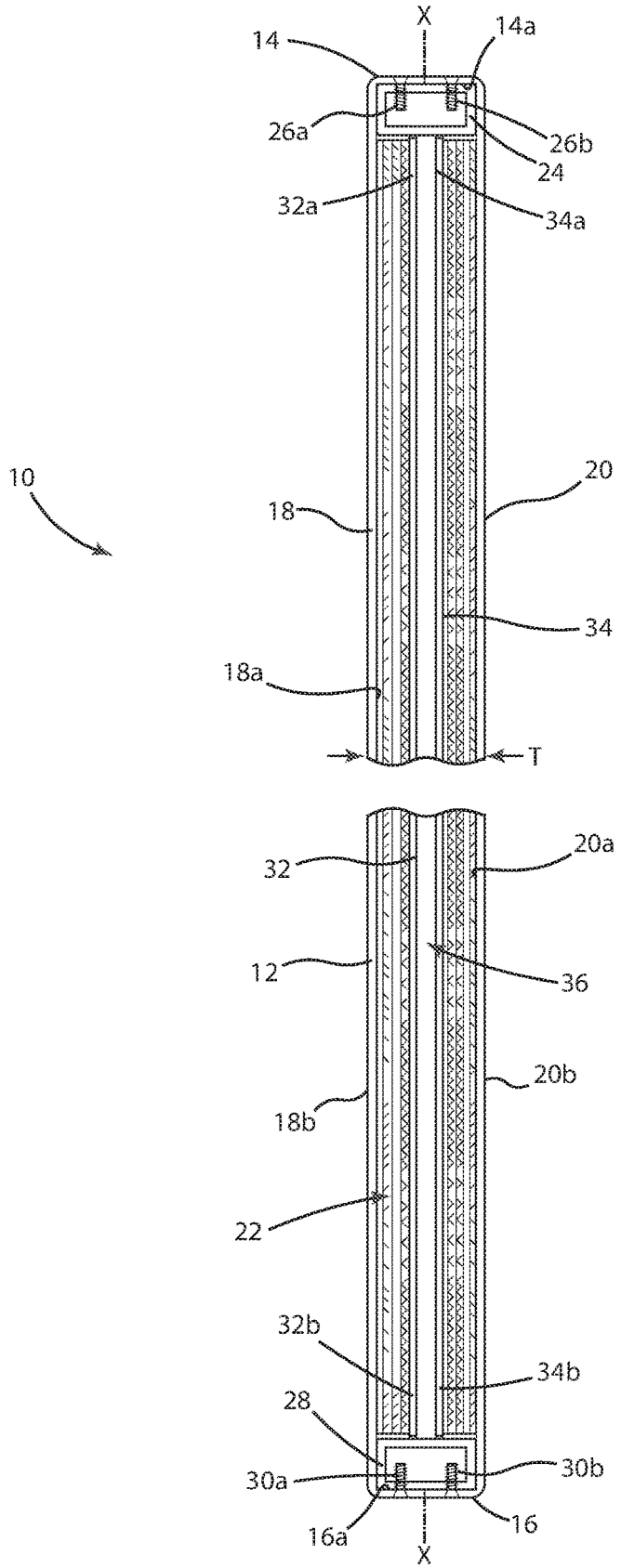
FIG. 1 is a breakaway, cross-sectional view of one embodiment of a swinging type fire door, in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a swinging type fire door, related components and methods of using the swinging type fire door, in accordance with the principles of the present disclosure. Alternate embodiments are also disclosed. Reference will now be made in detail to the exemplary embodiments of the present disclosure, which are illustrated in the accompanying figures. Turning to FIGS. 1-5, there is illustrated components of a swinging type fire door 10.

The components of swinging type fire door 10 can be fabricated from materials including metals, polymers and/or composites, depending on the particular application. For example, the components of swinging type fire door 10, individually or collectively, can be fabricated from materials such as aluminum, steel, iron, stainless steel, titanium, titanium alloys, cobalt-chrome, stainless steel alloys, semi-rigid and rigid materials, plastics, elastomers, rubbers and/or rigid polymers. Various components of swinging type fire door 10 may have material composites, including the above materials, to achieve various desired characteristics such as strength, rigidity, elasticity, performance and durability. The components of swinging type fire door 10, individually or collectively, may also be fabricated from a heterogeneous material such as a combination of two or more of the above-described materials. The components of swinging type fire door 10 can be extruded, molded, injection molded, cast, pressed and/or machined. The components of swinging type fire door 10 may be monolithically formed, integrally connected or include fastening elements and/or instruments, as described herein.

In some embodiments, swinging type fire door 10 includes a 1¾ inch thick assembly designed to retrofit into existing steel door frames. In some embodiments, swinging type fire door 10 has a 45-minute fire rating. In some embodiments, swinging type fire door 10 includes a proprietary layering of strategically placed metal components capable of stopping multiple shots from an AR-15 platform. In some embodiments, swinging type fire door 10 has a symmetrical design to provide unilateral protection from fire and ballistics. In some embodiments, swinging type fire door 10 includes a vision kit to maximize security surveillance. In some embodiments, the exterior of swinging type fire door 10 has a powder coated wood-like finish to provide color durability, and discreet unassuming protection. In some embodiments, swinging type fire door 10 is designed to accept an array of mechanical, electrical and digital access points.

In some embodiments, swinging type fire door 10 includes a first outer layer made from 12 gauge (Ga) hot rolled steel. A first ½ inch void is filled with 16 Ga hot rolled steel stiffeners and glass mineral wool with ECOSE® technology, available from Knauf Insulation LLC of Shelbyville, Ind. A first inner layer is made from 12 Ga hot rolled steel. A 5/16 inch air gap separation is provided. A second inner layer is made from 12 Ga hot rolled steel. A second ½ inch void is filled with 16 Ga hot rolled steel stiffeners and glass mineral wool with ECOSE® technology, available from Knauf Insulation LLC of Shelbyville, Ind. A second outer layer is made from 12 Ga hot rolled steel. A perimeter structure of the door panel consists of a ¾ inch×1½ inch×11 Ga hot rolled steel rectangular tube.

In some embodiments, the assembly of swinging type fire door 10 includes attaching two outer layers to an interior tube frame with #8-32 flat head socket drive screws at vertical, top and bottom edges of the panels. In some embodiments, the outer layers consist of 12 Ga hot rolled steel bent into 5 sided pans. The outer layers have 16 Ga hot rolled steel hat channel brake shape stiffeners welded to the inside surface. The stiffener is welded every 6 inches on center to the outer layers. The stiffeners are located at a maximum of 15 inches apart on center running vertically the full height of the door panel. The outer layers are powder coated to provide the appearance of multiple species of wood grain and coloring. The interior perimeter of the door consists of ¾ inch×1½ inch×11 Ga hot rolled steel tube welded at the corners. The outer layers of the door panel are fastened to the inner steel tube frame with #8-32 flat head socket drive screws at a maximum of 14 inches on center. The two (2) inner layers are flat 12 Ga hot rolled steel panels. The inner layers are attached to the 16 Ga stiffeners of the outer door panel with #8 hex head self-drilling steel screws at a maximum of 14 inches on center. The outer and inner panels are separated by a1/2 inch high stiffener and the ½ inch void is filled with glass mineral wool with ECOSE® technology. The spacing between the two (2) inner layers is 5/16 inch. The 5/16 inch gap is open air space. All the layers are prepped with cutouts for lockset hardware, attachment holes, vision kit, hinges, closers and any additional hardware required. The two outer door panel assemblies are connected thru the vision lite opening with 12 Ga flats, approximately 4 inches in length, welded to the stiffeners and edge of outer panels. The vision lite consists of six layers of glass laminated together using a combination of ceramic glass, borosilicate glass, annealed glass, tempered glass, polyvinyl butyral interlayer and intumescent interlayer. The glass assembly is wrapped around the edge with high temperature ceramic fiber tape. The glass is set into the vision lite opening and the perimeter gap is filled with fire barrier sealant. The vision lite kit consists of two frames of 12 Ga hot rolled steel with countersunk holes for #1 0-24 steel screws located at a maximum of 5½ inches on center. The vision lite frame and glass is separated by intumescent tape as a glazing gasket.

In some embodiments, the outer layers have hot rolled steel thicknesses between 16 Ga and 11 Ga. In some embodiments, the inner layers have hot rolled steel thicknesses between 16 Ga and 11 Ga. In some embodiments, the spacing between outer and inner layers is from 1/16 inch to ¾ inch. In some embodiments, swinging type fire door 10 includes between two and five layers with various spacing and fillers. In some embodiments, the filler material comprises carbon fiber, ceramic fiber, woven fiberglass panels, resin composite panels, polycarbonate panels, or a combination thereof. In some embodiments, the glass vision panels include 4 to 12 multiple laminated layers. In some embodiments, the layers consist of annealed glass, borosilicate glass, ceramic glass, polyvinyl butyral interlayers, intumescent interlayers, polycarbonate. In some embodiments, the vision panels include all glass assemblies or glass/polycarbonate assemblies.

Swinging type fire door 10 includes a frame 12 extending along a longitudinal axis X between a top wall 14 and an opposite bottom wall 16. Frame 12 includes a first side wall 18 and an opposite second side wall 20. Walls 18, 20 each extend from wall 14 to wall 16. Walls 18, 20 each extend perpendicular to axis X. In some embodiments, wall 14 and/or wall 16 may be disposed at alternate orientations, relative to axis X, such as, for example, transverse, perpendicular and/or other angular orientations such as acute or obtuse, co-axial and/or may be offset or staggered. An inner surface 14*a* of wall 14, an inner surface 16*a* of wall, an inner surface 18*a* of wall and an inner surface 20*a* of wall 20 define a cavity 22 configured for disposal of additional components of swinging type fire door 10, as discussed herein. In some embodiments, frame 12 comprises 10 Ga hot rolled steel or 12 Ga hot rolled steel. That is, wall 14, wall 16, wall 18 and wall 20 are each made from 10 Ga hot rolled steel or 12 Ga hot rolled steel.

A tube 24 is positioned within cavity 22 such that tube 24 directly engages surfaces 14*a*, 18*a*, 20*a*. Tube 24 is secured to frame 12 by a pair of spaced apart screws 26*a*, 26*b*. In particular, screws 26*a*, 26*b* each extend through wall 14 and tube 24 to secure tube 24 to frame 12. A tube 28 is positioned within cavity 22 such that tube 28 directly engages surfaces 16*a*, 18*a*, 20*a*. Tube 28 is secured to frame 12 by a pair of spaced apart screws 30*a*, 30*b*. In particular, screws 30*a*, 30*b* each extend through wall 16 and tube 28 to secure tube 28 to frame 12. In some embodiments, tube 24 and/or tube 28 are made from 11 Ga steel. In some embodiments, tube 24 and tube 28 each comprises ¾ inch×1½ inch×11 Ga steel. In some embodiments, tube 24 and/or tube 28 are fixed to frame 12 using threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. Tubes 24, 28 each have a rectangular cross-sectional configuration. However, in some embodiments, tube 24 and/or tube 28 may have various cross section configurations, such as, for example, circular, oval, oblong, triangular, square, polygonal, irregular, uniform, non-uniform, variable and/or tapered. Screws 26*a*, 26*b*, 30*a*, 30*b* each extend parallel to axis X and are offset from axis X. However, in some embodiments, screws 26*a*, 26*b*, 30*a*, 30*b* may be disposed at alternate orientations, relative to axis X, such as, for example, transverse, perpendicular and/or other angular orientations such as acute or obtuse, co-axial and/or may be staggered. In some embodiments, screws 26*a*, 26*b*, 30*a*, 30*b* are #8-32 black oxide socket drive machine screws.

Spaced apart inner walls 32, 34 are positioned in cavity 22 between tube 24 and tube 28. In particular, wall 32 includes an end 32*a* that directly engages tube 24 and an opposite end 32*b* that directly engages tube 28. Likewise, wall 34 includes an end 34*a* that directly engages tube 24 and an opposite end 34*b* that directly engages tube 28. Walls 32, 34 each extend parallel to axis X. Wall 32 is spaced apart from wall 34 by a gap 36. In some embodiments, gap 36 is a 5/16 inch air gap. In some embodiments, gap 36 consists of void space and is free of any solid or liquid components. In some embodiments, wall 32 is uniformly spaced apart from wall 34 from tube 24 to tube 28 such that gap 36 has a uniform width or diameter from tube 24 to tube 28. Walls 32, 34 are each made from 10 Ga hot rolled steel or 12 Ga hot rolled steel. In some embodiments, wall 32 and/or wall 34 are fixed to tubes 24, 28 using threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, wall 32 and/or wall 34 may be disposed at alternate orientations, relative to axis X, such as, for example, transverse, perpendicular and/or other angular orientations such as acute or obtuse, co-axial and/or may be offset or staggered.

A filler material 38 is positioned in cavity 22 between wall 18 and wall 32 and between wall 20 and wall 34. In some embodiments, material 38 comprises glass mineral wool. In some embodiments, material 38 comprises glass mineral wool and a thermoset inert polymer bonding agent. In some embodiments, material 38 has a thickness between about 0.5 inches and 1.5 inches. In some embodiments, material 38 has a thickness of about 1 inch. In some embodiments, material 38 has a thickness of 1 inch. In some embodiments, material 38 has between 1 lbs./ft$^3$ and 4 lbs./ft$^3$. In some embodiments, material 38 has a density of about 2.4 lbs./ft$^3$. In some embodiments, material 38 has a density of 2.4 lbs./ft$^3$. In some embodiments, the glass mineral wool comprises man made vitreous (silicate) fibers with a random orientation and with alkaline oxide and alkali earth oxide ($Na_2O+K_2O+CaO+MgO+BaO$) content greater than 18% by weight. In some embodiments, the thermoset inert polymer bonding agent is derived from plant starches. In some embodiments, material 38 comprises between about 87% and about 100% of the biosoluble glass mineral wool and between about 0% and about 13% of the thermoset inert polymer bonding agent. In some embodiments, material 38 comprises between 87% and 100% of the biosoluble glass mineral wool and between 0% and 13% of the thermoset inert polymer bonding agent. In some embodiments, material 38 comprises about 87% of the biosoluble glass mineral wool and about 13% of the thermoset inert polymer bonding agent. In some embodiments, material 38 comprises glass mineral wool and a thermoset inert polymer bonding agent, wherein the biosoluble glass mineral wool comprises vitreous silicate fibers and an oxide. In one embodiment, the oxide comprises $Na_2O+K_2O+CaO+MgO+BaO$. In some embodiments, filler material 38 is positioned in cavity 22 between wall 18 and wall 32 such that filler material 38 directly engages surface 18*a* of wall 18 and outer surfaces of wall 32, tube 24 and tube 28. In some embodiments, filler material 38 is positioned in cavity 22 between wall 20 and wall 34 such that filler material 38 directly engages surface 20*a* of wall 20 and outer surfaces of wall 34, tube 24 and tube 28. In some embodiments, material 38 consists of glass mineral wool with ECOSE® technology sold by Knauf Insulation LLC in Shelbyville, Ind.

Figure 2:
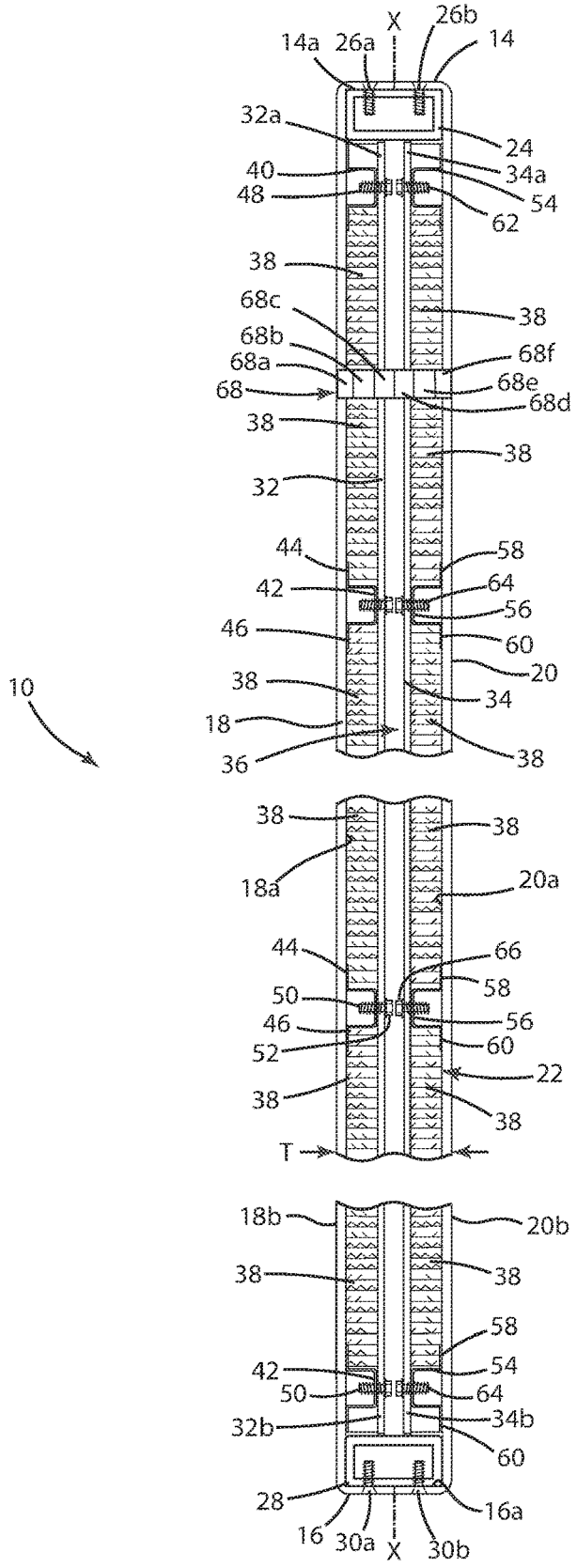
FIG. 2 is a breakaway, cross-sectional view of one embodiment of a swinging type fire door, in accordance with the principles of the present disclosure.
Figure 2A:
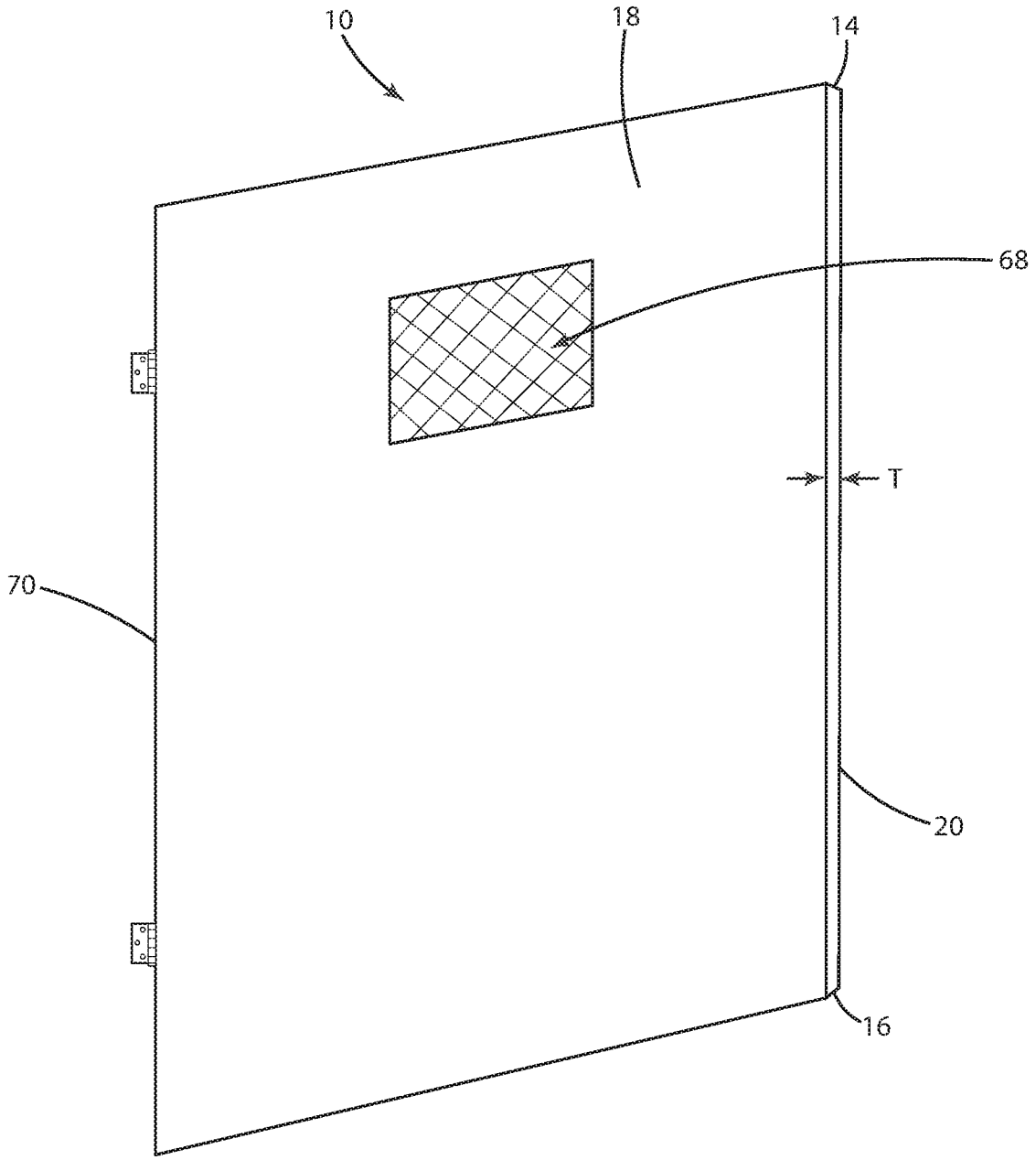
FIG. 2A is a perspective view of the swinging type fire door shown in FIG. 2.

In one embodiment, shown in FIG. 2, door 10 includes a plurality of spaced apart stiffeners 40 positioned between wall 18 and wall 32. Stiffeners 40 each include a body 42 and spaced apart legs 44, 46 extending from opposite ends of body 42. Legs 44, 46 are planar and each extend parallel to axis X. Legs 44, 46 directly engage surface 18*a*. A planar portion of body 42 directly engages an outer surface of wall 32. A screw 48 extends through the planar portion of body 42 to couple stiffeners 40 to wall 32 such that a shaft 50 of screw 48 extends through the planar portion of body 42 and a head 52 of screw 48 is positioned in gap 36. Filler material 38 is positioned between adjacent stiffeners 40, as shown in FIG. 2. Door 10 further includes a plurality of spaced apart stiffeners 54 positioned between wall 20 and wall 34. Stiffeners 54 each include a body 56 and spaced apart legs 58, 60 extending from opposite ends of body 56. Legs 58, 60 are planar and each extend parallel to axis X. Legs 58, 60 directly engage surface 20*a*. A planar portion of body 56 directly engages an outer surface of wall 34. A screw 62 extends through the planar portion of body 56 to couple stiffeners 54 to wall 34 such that a shaft 64 of screw 62 extends through the planar portion of body 56 and a head 66 of screw 62 is positioned in gap 36. Filler material 38 is positioned between adjacent stiffeners 54, as shown in FIG. 2.

Stiffeners 40, 54 are each made from 16 Ga hot rolled steel. In some embodiments, legs 44, 46 can be variously connected with wall 18 and/or legs 58, 60 can be variously connected with wall 20, such as, for example, threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, legs 44, 46 and the planar portion of body 42 and/or legs 58, 60 and the planar portion of body 56 may be disposed at alternate orientations, relative to axis X, such as, for example, transverse, perpendicular and/or other angular orientations such as acute or obtuse, co-axial and/or may be offset or staggered.

In one embodiment, shown in FIG. 2, door 10 includes a window 68 configured to allow a person to see through door 10 to detect the presence or absence of persons or objects on an opposite side of door 10. It is envisioned that window 68 can include one or a plurality of layers. In one embodiment, window 68 includes between four and twelve layers. In one embodiment, window 68 includes layers 68*a*, 68*b*, 68*c*, 68*d*, 68*e*, 68*f*. Layers 68*a*, 68*b*, 68*c*, 68*d*, 68*e*, 68*f* comprise glass and are laminated together using a combination of ceramic glass, borosilicate glass, annealed glass, tempered glass, polyvinyl butyral interlayer and intumescent interlayer. After layers 68*a*, 68*b*, 68*c*, 68*d*, 68*e*, 68*f* are laminated together to form a glass assembly, outer edges of the glass assembly are wrapped with a high temperature ceramic fiber tape. The glass assembly is then fit into an opening in door 10 and a perimeter gap is filled with fire barrier sealant.

Figure 3:
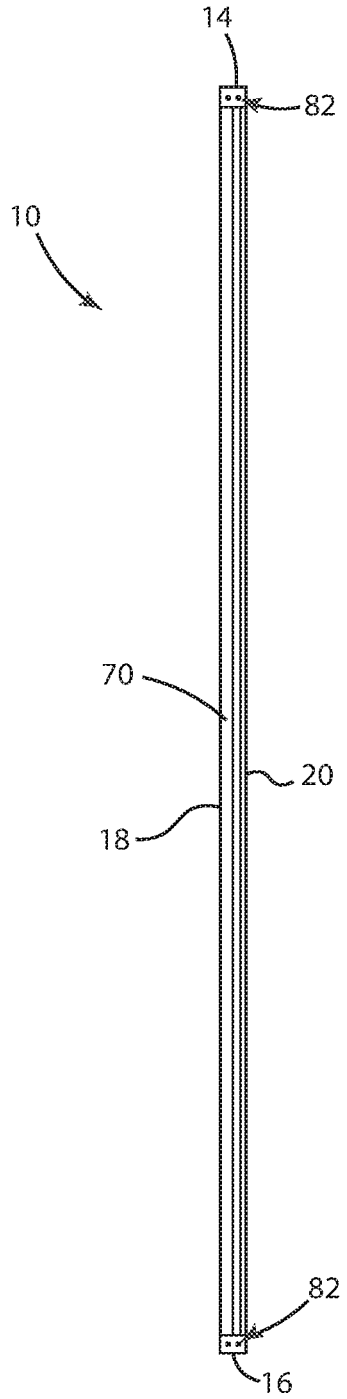
FIG. 3 is an end view of the swinging type fire door shown in FIG. 2.
Figure 4:
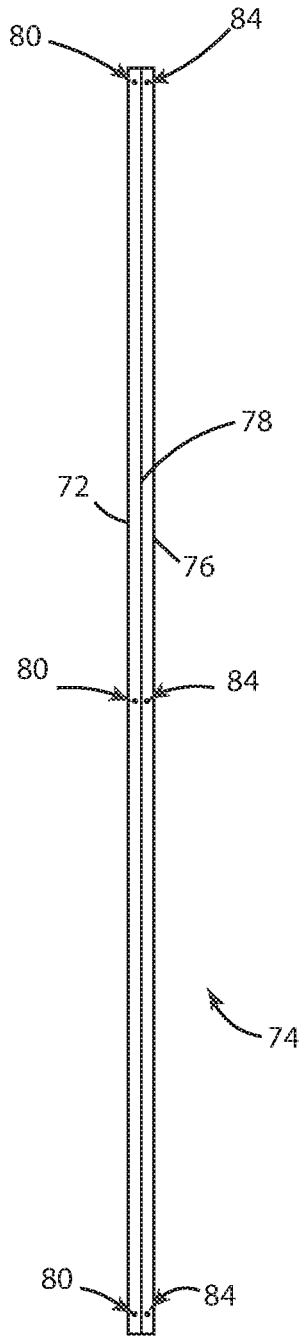
FIG. 4 is a side view of a component of the swinging type fire door shown in FIG. 2, in accordance with the principles of the present disclosure.

Frame 12 includes an end wall 70 that extends from wall 14 to wall 16 and from wall 18 to wall 20, as shown in FIG. 3. Wall 70 is configured for engagement with a side 72 of a component 74. Component 74 includes a side 76 that is pivotable relative to side 72 about a continuous heavy-duty gear hinge, such as, for example, hinge 78. Side 76 is configured to be attached to a door frame to allow door 10 to pivot relative to the door frame to open and close door 10, as discussed herein. In one embodiment, side 72 includes one or a plurality of pre-drilled holes 80 that are configured for alignment with one or a plurality of holes 82 in wall 70 such that a fastener, such as, for example, a screw can be inserted through holes 80, 82 to secure component 74 to wall 70. In one embodiment, side 76 includes one or a plurality of pre-drilled holes 84 that are configured for alignment with one or a plurality of holes in a door frame such that a fastener, such as, for example, a screw can be inserted through hole 84 and the hole in the door frame to secure component 74 to the door frame.

Figure 5:
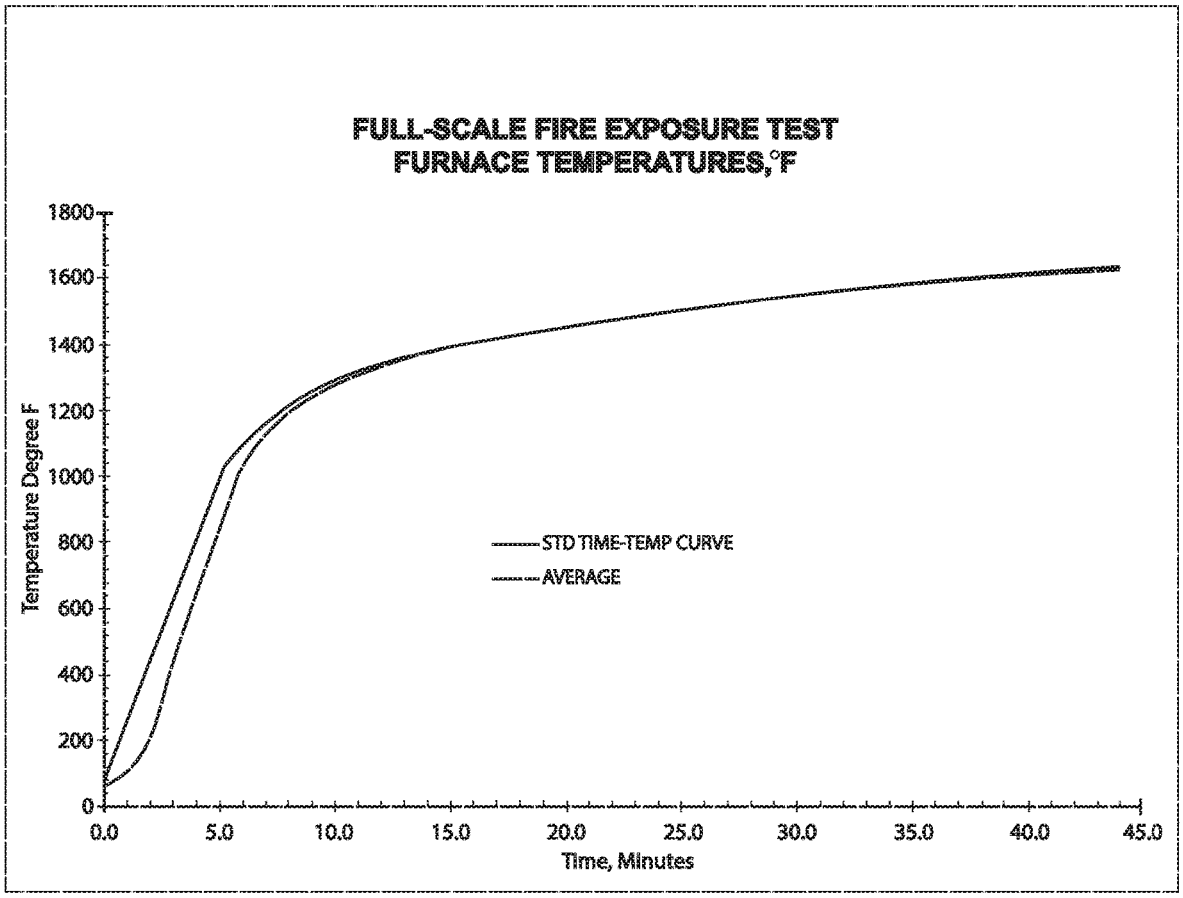
FIG. 5 is a graph showing results from a test conducted on the swinging type fire door shown in FIG. 2.

Door 10 has a maximum thickness T defined by the distance from an outer surface 18*b* of wall 18 to an opposite outer surface 20*b* of wall 20. In one embodiment, thickness T is less than or equal to 1¾ inches to allow an existing steel door frame to be retrofit with door 10, as discussed herein. That is, since conventional steel door frames are designed to fit doors that are 1¾ inches thick, such door frames cannot be retrofitted with doors that are thicker than 1¾ inches thick. Indeed, doors that are thicker than 1¾ inch will not fit within conventional steel door frames and thus require a custom door frame to accommodate the increased thickness. Heretofore unknown are fire doors that are less than or equal to 1¾ inches and that also have an acceptable fire-resistance rating (e.g., 45 minutes). That is, conventional fire doors that are less than or equal to 1¾ inches do not have an acceptable fire-resistance rating and are therefore not suitable for use in buildings that require a selected fire-resistance or fire protection rating. However, Applicant has unexpectedly found that the combination of materials used in door 10 and their construction to form door 10 has resulted in a fire door that is less than or equal to 1¾ inches and that also has a fire-resistance rating of 45 minutes, as shown in FIG. 5, and is in compliance with ANSI/UL 10C, Positive Pressure of Fire Tests of Door Assemblies, ANSI/UL 10B, Fire Tests of Door Assemblies, and CAN/ULC S104, Standard Method for Fire Tests of Door Assemblies.

In one embodiment, door 10 is assembled by inserting screws 26*a*, 26*b* through wall 14 and into tube 24 and inserting screws 30*a*, 30*b* through wall 16 and into tube 24 to couple walls 18, 20 to tubes 24, 28. Legs 44, 46 of stiffeners 40 are welded to surface 18*a* and legs 58, 60 of stiffeners 54 are welded to surface 20*a*. In one embodiment, stiffeners 40 and stiffeners 54 are welded every six inches on center to walls 18, 20. In one embodiment, stiffeners 40 and stiffeners 54 are located at a maximum of fifteen inches apart on center running vertically the full height of door 10. Outer surfaces of walls 18, 20 are powder coated to provide the appearance of multiple species of wood grain and coloring. Wall 32 is attached to the planar portions of bodies 42 of stiffeners 40 using screws 48 and wall 32 is attached to the planar portions of bodies 56 of stiffeners 54 using screws 62. Filler material 38 is positioned between adjacent stiffeners 40 and adjacent stiffeners 54. Walls 18, 20, 32, 34 are prepped with cutouts for lockset hardware, attachment holes, window 68, hinges, closers and any additional hardware. Walls 18, 20 are connected through the opening for window 68 with four inch long 12 Ga steel flats that are welded to stiffeners 40, 54 and edges of walls 18, 20. After layers 68*a*, 68*b*, 68*c*, 68*d*, 68*e*, 68*f* are laminated together to form a glass assembly, outer edges of the glass assembly are wrapped with a high temperature ceramic fiber tape. The glass assembly is then fit into the opening in door 10 and a perimeter gap is filled with fire barrier sealant.

In operation and use, door 10 can be provided with a new door frame that allows door 10 to swing open and closed within the new door frame. The new door frame can be installed in a wall of a building or other structure. Alternatively, door 10 can be retrofitted into an existing steel door frame, such as, for example, an existing door frame having an all steel welded construction, as discussed herein. The existing door frame is a masonry pour-in-place type door frame and is mounted in a wall made of concrete block, brick and block or poured concrete. A 1¾ inch thick existing door is removed from hinges of the existing door frame in order to attach door 10 to the existing door frame. The hinges are removed from the existing door frame and are discarded. New screws are inserted through holes 80 in component 74 and holes 82 in wall 70 to couple component 74 to door 10. Door 10 is positioned within an opening of the existing door frame for attachment to the existing door frame. New screws are inserted through holes 84 in component 74 and holes in the existing door frame to couple component 74 and door 10 to the existing door frame. The new screws are installed with an impact gun. The door closer is then mounted to door 10 and a top section of the existing door frame is pre-drilled with holes to accept the attachment bracket for installation of a closer arm (not shown). The closer is adjusted for closing speed and latching speed. A dome stop (not shown) is then mounted to the floor of the building or other structure to keep door 10 from overswinging.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A swinging type fire door comprising:

a frame comprising opposite top and bottom walls and opposite first and second side walls each extending from the top wall to the bottom wall;

a first tube coupled to the top wall;

a second tube coupled to the bottom wall;

an inner wall having a first end coupled directly to the first tube and a second end coupled directly to the second tube; and a filler material positioned between the inner wall and at least one of the side walls.

2. The swinging type fire door recited in claim 1, wherein the filler material comprises glass mineral wool.

3. The swinging type fire door recited in claim 1, wherein the filler material comprises biosoluble glass mineral wool and a thermoset inert polymer bonding agent.

4. The swinging type fire door recited in claim 3, wherein the filler material comprises between 87% and 100% of the biosoluble glass mineral wool and between 0% and 13% of the thermoset inert polymer bonding agent.

5. The swinging type fire door recited in claim 3, wherein the biosoluble glass mineral wool comprises vitreous silicate fibers and an oxide.

6. The swinging type fire door recited in claim 1, wherein the filler material comprises a first amount of filler material positioned between the inner wall and the first side wall and a second amount of filler material positioned between the inner wall and the second side wall.

7. The swinging type fire door recited in claim 1, wherein the tubes and the inner wall are enclosed within a cavity of the frame.

8. The swinging type fire door recited in claim 1, wherein the inner wall is a first inner wall and the swinging type fire door further comprises a second inner wall that is spaced apart from the first inner wall by a gap, the second inner wall having a first end coupled directly to the first tube and a second end coupled directly to the second tube, the filler material positioned between the first inner wall and the first side wall and between the second inner wall and the second side wall.

9. The swinging type fire door recited in claim 1, wherein:

the first tube comprises opposite top and bottom surfaces and opposite first and second side surfaces that each extend from the top surface to the bottom surface, the top surface directly engaging an inner surface of the top wall, the first side surface directly engaging an inner surface of the first side wall and the second side surface directly engaging an inner surface of the second side wall; and the second tube comprises opposite top and bottom surfaces and opposite first and second side surfaces that each extend from the top surface of the second tube to the bottom surface of the second tube, the top surface of the second tube directly engaging an inner surface of the bottom wall, the first side surface of the second tube directly engaging the inner surface of the first side wall and the second side surface of the second tube directly engaging the inner surface of the second side wall.

10. A swinging type fire door comprising:

a frame comprising opposite top and bottom walls and opposite first and second side walls each extending from the top wall to the bottom wall;

a first tube coupled to the top wall;

a second tube coupled to the bottom wall;

spaced apart first and second inner walls each having a first end coupled to the first tube and a second end coupled to the second tube;

a plurality of spaced apart first stiffeners positioned between the first side wall and the first inner wall;

a plurality of spaced apart second stiffeners positioned between the second side wall and the second inner wall; and a filler material positioned between adjacent first stiffeners and adjacent second stiffeners.

11. The swinging type fire door recited in claim 10, wherein the filler material comprises glass mineral wool.

12. The swinging type fire door recited in claim 10, wherein the filler material comprises biosoluble glass mineral wool and a thermoset inert polymer bonding agent.

13. The swinging type fire door recited in claim 12, wherein the filler material comprises between 87% and 100% of the biosoluble glass mineral wool and between 0% and 13% of the thermoset inert polymer bonding agent.

14. The swinging type fire door recited in claim 12, wherein the filler material comprises about 87% of the biosoluble glass mineral wool and about 13% of the thermoset inert polymer bonding agent.

15. The swinging type fire door recited in claim 12, wherein the biosoluble glass mineral wool comprises vitreous silicate fibers and an oxide.

16. The swinging type fire door recited in claim 15, wherein the oxide comprises $Na_2O+K_2O+CaO+MgO+BaO$.

17. The swinging type fire door recited in claim 10, wherein:

the first stiffeners each include a body and a pair of legs each extending outwardly from the body, the bodies of the first stiffeners being coupled to the first inner wall, the legs of the first stiffeners being coupled to the first side wall; and the swinging type fire door further comprises a plurality of first fasteners, the first fasteners each extending through the first inner wall and the body of one of the first stiffeners.

18. The swinging type fire door recited in claim 17, wherein:

the second stiffeners each include a body and a pair of legs each extending outwardly from the body, the bodies of the second stiffeners being coupled to the second inner wall, the legs of the second stiffeners being coupled to the second side wall; and the swinging type fire door further comprises a plurality of second fasteners, the second fasteners each extending through the second inner wall and the body of one of the second stiffeners.

19. The swinging type fire door recited in claim 10, wherein:

the frame comprises 12 gauge hot rolled steel;

the tubes each comprise 11 gauge steel; and the stiffeners each comprise 16 gauge hot rolled steel.

20. A swinging type fire door comprising:

a frame comprising opposite top and bottom walls and opposite first and second side walls each extending from the top wall to the bottom wall;

a first tube coupled to the top wall by spaced apart socket drive machine screws;

a second tube coupled to the bottom wall by spaced apart socket drive machine screws;

spaced apart first and second inner walls each having a first end coupled to the first tube and a second end coupled to the second tube;

a plurality of spaced apart first stiffeners positioned between the first side wall and the first inner wall;

a plurality of first fasteners extending through the first inner wall and into one of the first stiffeners to couple the first stiffeners to the frame;

a plurality of spaced apart second stiffeners positioned between the second side wall and the second inner wall;

a plurality of second fasteners extending through the second inner wall and into one of the second stiffeners to couple the second stiffeners to the frame; and a filler material positioned between adjacent first stiffeners and adjacent second stiffeners, the filler material comprising about 87% of biosoluble glass mineral wool and about 13% of a thermoset inert polymer bonding agent.

* * * * *